US006129124A

United States Patent [19]

Smith et al.

[11] Patent Number: 6,129,124

[45] Date of Patent: Oct. 10, 2000

[54] WIRE TIGHTENING DEVICE

[76] Inventors: Duane David Smith, 2333 Bering St., No. 326, Houston, Tex. 77057; David Franklin Els, Rte. 1, Box 7-DA, Ledbetter, Tex. 78946

[21] Appl. No.: 09/287,784

[22] Filed: Apr. 7, 1999

[51] Int. Cl.[7] ..... B21F 9/00

[52] U.S. Cl. ..... 140/123.5; 24/71.1

[58] Field of Search ..... 140/102.5, 123.5, 140/124; 256/40; 24/71.1, 909, 68 D

[56] References Cited

U.S. PATENT DOCUMENTS

| | | | |
|---|---|---|---|
| 1,476,026 | 12/1923 | Barber . | |
| 1,789,891 | 1/1931 | Alke | 140/102.5 |
| 2,068,176 | 1/1937 | Hedrick | 140/123.5 |
| 2,086,317 | 7/1937 | Hunt . | |
| 2,311,792 | 2/1943 | Valkenburgh . | |
| 2,816,342 | 12/1957 | Hyre | 24/68 D |
| 5,012,559 | 5/1991 | Flannery . | |
| 5,170,536 | 12/1992 | McBroom . | |

FOREIGN PATENT DOCUMENTS

| | | |
|---|---|---|
| 46967 | 2/1933 | Denmark . |
| 497750 | 5/1930 | Germany . |

*Primary Examiner*—Lowell A. Larson
*Attorney, Agent, or Firm*—Stephen R. Greiner

[57] ABSTRACT

A wire tightening device including a clip and a leverage-generating tool therefor. The clip includes a tensioning arm, with an outer end having an upwardly-extending crook, and a retaining arm joined together, and held in axial alignment, by a laterally-extending, winding portion. The winding portion has a pair of legs projecting from the inner ends of the arms and an open loop joining the legs in a spaced-apart relationship. The open loop has an outer diameter greater than the distance between the inner ends of the arms. The leverage-generating tool, on the other hand, includes a handle having a tine and a key at one end thereof for engaging the clip. The key has a vertical member adapted for positioning snugly between the legs of the clip when the tine is inserted into the center of the open loop.

8 Claims, 2 Drawing Sheets

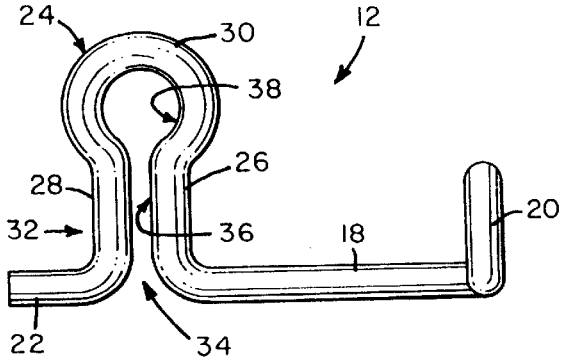
FIG. 1
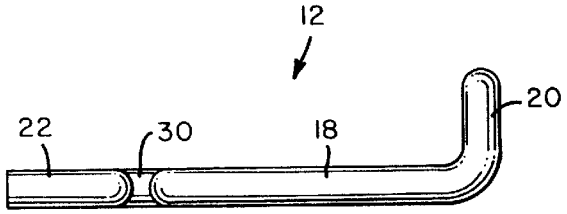
FIG. 2
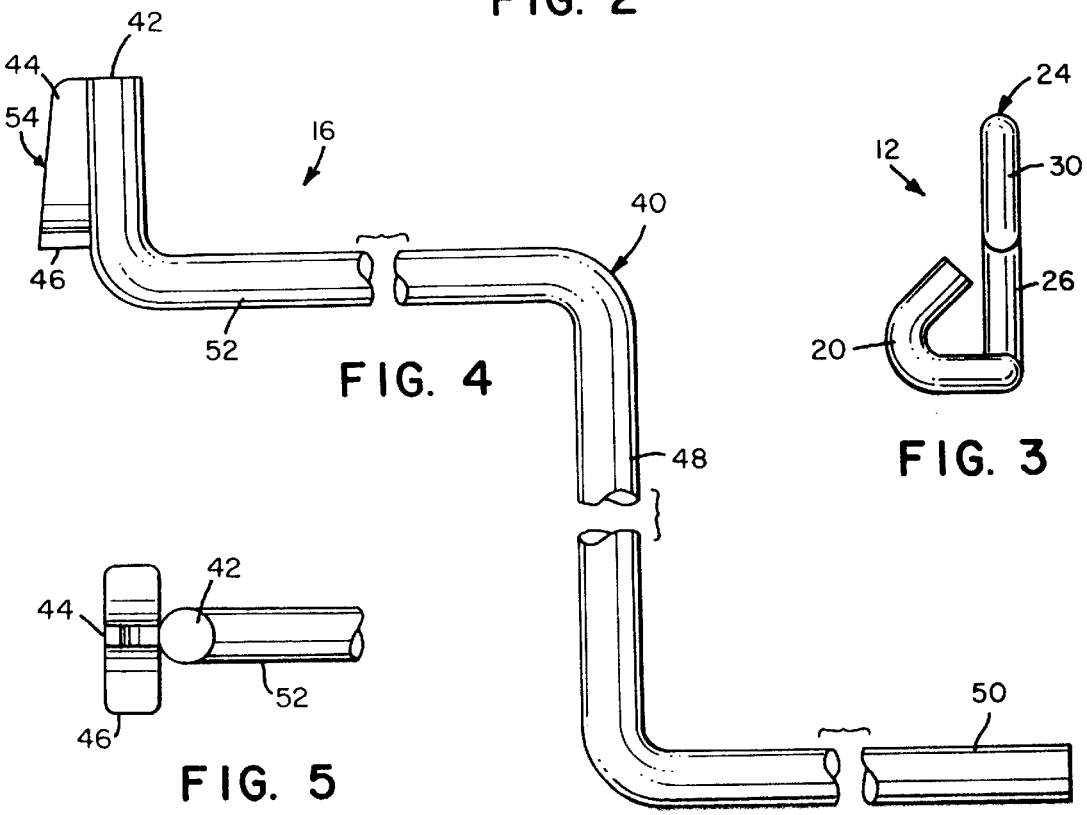
FIG. 4
FIG. 3
FIG. 5

WIRE TIGHTENING DEVICE

FIELD OF THE INVENTION

The present invention relates generally to fences and, more particularly, to winding-type, wire stretchers therefor.

BACKGROUND OF THE INVENTION

Many devices have been proposed for applying tension to fence wires that have stretched over time and become slack. A few of the better devices use small clips upon which slack, fence wire may be wound and retained for the remainder of the fence's life. Unfortunately, a typical clip employs only friction to hold in place the wire wound upon it. Thus, bumps from livestock, for example, can lead to the unwinding of slack wire from a conventional clip and to an ineffective fence.

SUMMARY OF THE INVENTION

In light of the problems associated with the known devices for applying tension to wires used in fences and the like, it is a principal object of the invention to provide a wire tightening device which incorporates features which will prevent the inadvertent release of wound, slack wire.

It is another object of the invention to provide a device of the type described which may be utilized to quickly and easily tighten a slack, fence wire.

It is an object of the invention to provide improved elements and arrangements thereof in a wire tightening device for the purposes described which is lightweight in construction, dependable in use, and inexpensive to manufacture.

Briefly, the wire tightening device in accordance with this invention achieves the intended objects by featuring a clip and a leverage-generating tool for applying the clip to a wire. The clip includes a pair of arms, one of which having an upwardly-extending crook at its outer end, held in alignment by a laterally-extending, winding portion. The winding portion has a pair of legs projecting from the inner ends of the arms and an open loop joining the legs. The open loop has an outer diameter greater than the distance between the inner ends of the arms. The leverage-generating tool, on the other hand, includes a handle with a key which may be positioned within the slot and against the legs of the clip for winding purposes.

The foregoing and other objects, features and advantages of the present invention will become readily apparent upon further review of the following detailed description of the preferred embodiment as illustrated in the accompanying drawings.

BRIEF DESCRIPTION OF THE DRAWINGS

The present invention may be more readily described with reference to the accompanying drawings, in which:

FIG. 1 is a top view of a clip forming part of a wire tightening device in accordance with the present invention.

FIG. 2 is a side view of the clip of FIG. 1.

FIG. 3 is an end view of the clip of FIG. 1.

FIG. 4 is a side view of a leverage-generating tool forming part of the wire tightening device.

FIG. 5 is a top view of a portion on the leverage-generating tool of FIG. 4.

Similar reference characters denote corresponding features consistently throughout the accompanying drawings.

DETAILED DESCRIPTION OF THE PREFERRED EMBODIMENT

Figure 6:
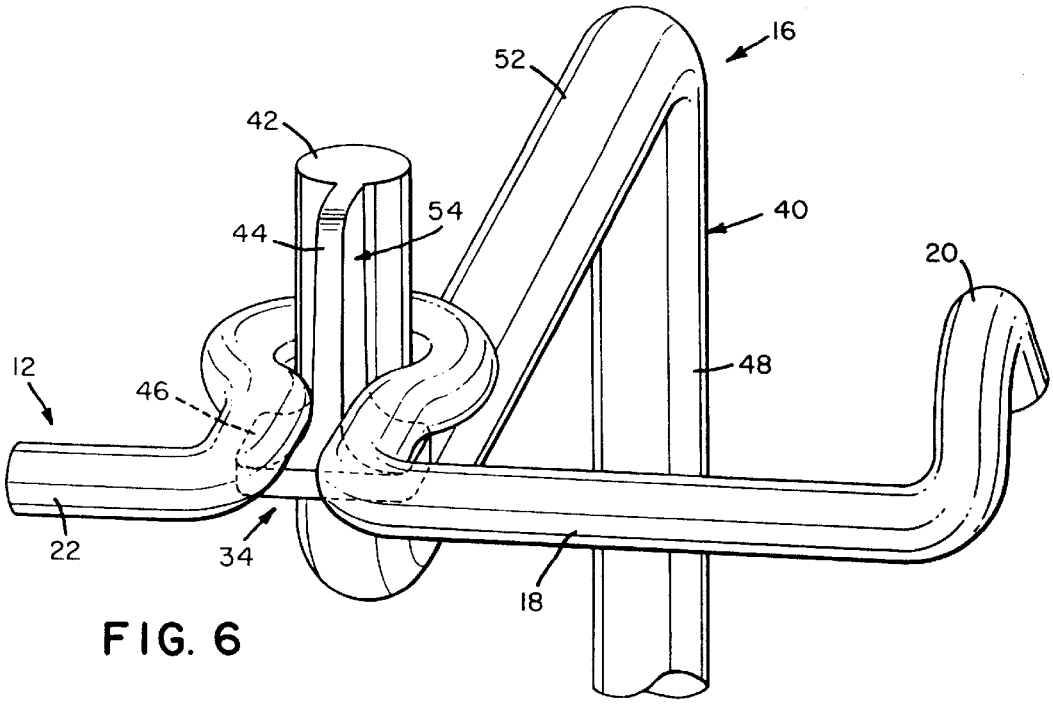
FIG. 6 is a perspective view showing the engagement of the clip and the leverage-generating tool.
Figure 7:
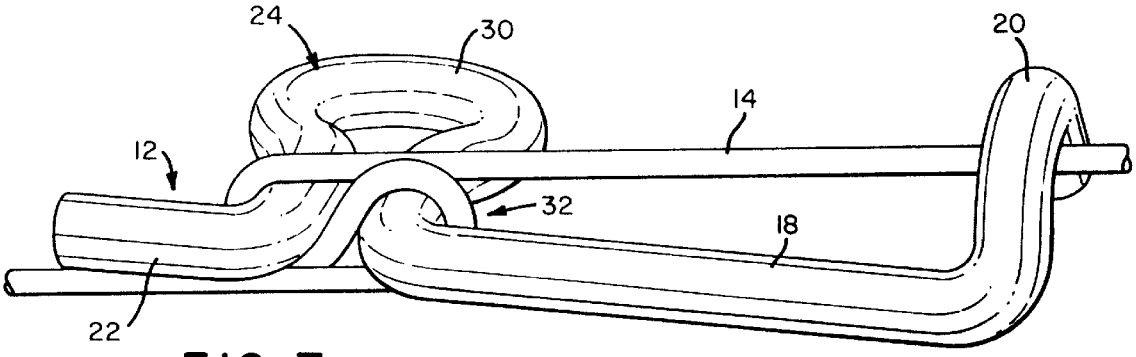
FIG. 7 is a perspective view showing the clip engaged with a fence wire and removing slack therefrom.

Referring now to the FIGS., a wire tightening device in accordance with the present invention is shown at 10. The device includes a clip 12 which is applied to a fence wire 14 to take up slack. Application of the clip 12 to the wire 14 is accomplished by means of a leverage-generating tool 16.

The clip 12 includes a tensioning arm 18, with an upwardly-extending crook 20 at its outer end, and a retaining arm 22 held in axial alignment by a laterally-extending, winding portion 24. The winding portion 24 has a pair of legs 26 and 28 projecting at right angles from the inner ends of the arms 18 and 22. The legs 26 and 28 are joined in a spaced-apart relationship by an open loop 30 having an outer diameter greater than the distance between the inner ends of the arms 18 and 22 to provide the portion 24 with a neck 32 adjacent the legs and a keyhole slot 34 extending through the neck. As shown, the slot 34 has a narrow, channel part 36 between the legs 26 and 28 and a wide, circular, terminal part 38 within the open loop 30.

The leverage-generating tool 16 includes a handle 40 with an attached key 54 for engaging the clip 12. The handle 40 has a lever portion 48 with a crank portion 50 extending at a right angle from its lower end. A guide portion 52 extends from the upper end of the lever portion 48 in a direction opposite that of the crank portion 50. Extending upwardly from the free end of the guide portion 52 is a tine 42 adapted for snug insertion into the terminal part 38 of the slot 34 in clip 12.

The key 54 is shaped like an inverted "T" and is welded to tine 42. The key 54 has a vertical member 44 which projects from tine 42 in a direction opposite guide portion 52. The key 54 also has a horizontal member 46 which extends at right angles from the bottom of the vertical member 44. As shown in FIG. 6, horizontal member 46 is located for positioning against the bottom of the clip 12 when vertical member 44 and tine 42 are positioned, respectively, in the channel part 36 and the terminal part 38 of slot 34.

The clip 12 and tool 16 are formed of durable materials. The clip 12 is preferably formed from a single length of stiff, 0.25 inch (0.64 cm) diameter wire. The handle 40, however, is formed from stiff, 0.375 inch (0.95 cm) diameter wire. If desired, the wire described above may be of the galvanized type. The key 54 is formed of stiff metal.

Use of the wire tightening device 10 is straightforward. First, tine 42 and vertical member 44 of tool 16 are inserted into slot 34 of clip 12. With the horizontal member 46 supporting clip 12, a length of slack, fence wire 14 is brought into the portion of the channel part 36 not occupied by vertical member 44. The handle 40 is now manually rotated to the extent possible, with slack wire 14 being gathered in neck 32. During rotation, vertical member 44 retains the legs 26 and 28 of the neck 32 in a spaced-apart relationship.

When continued rotation of the handle 40 has removed sufficient slack from the wire 14, the crook 20 is hooked on the wire 14 to secure the clip 12 permanently in place. The tool 16 may now be disengaged from the clip 12 for future use. The process of applying a clip 12 to a wire 14 requires less than one minute to perform.

While the invention has been described with a high degree of particularity, it will be appreciated by those skilled in the art that modifications may be made thereto. Therefore, it is to be understood that the present invention is not limited to the sole embodiment described above, but encompasses any and all embodiments within the scope of the following claims.

We claim:

1. A wire tightening clip, comprising:

a tensioning arm, with an outer end having an upwardly-extending crook, and a retaining arm joined together at their respective inner ends, and held in axial alignment, by a laterally-extending, winding portion, said winding portion having a pair of parallel legs projecting from said inner ends of said tensioning and retaining arms and an open loop joining said legs in a spaced-apart relationship, and said open loop having an outer diameter greater than the distance between said inner ends of said tensioning and retaining arms.

2. The wire tightening clip according to claim 1 wherein said clip is formed from a single piece of substantially rigid wire.

3. The wire tightening clip according to claim 1 wherein said winding portion includes a keyhole slot having a narrow, channel part extending between said legs and a relatively wide, circular, terminal part within said open loop.

4. A wire tightening device, comprising:

a clip including a tensioning arm, with an outer end having an upwardly-extending crook, and a retaining arm joined together at their respective inner ends, and held in axial alignment, by a laterally-extending, winding portion, said winding portion having a pair of parallel legs projecting from said inner ends of said tensioning and retaining arms and an open loop joining said legs in a spaced-apart relationship, said open loop having an outer diameter greater than the distance between said inner ends of said tensioning and retaining arms, and said winding portion having a keyhole slot with a narrow, channel part extending between said legs and a relatively wide, circular, terminal part within said open loop; and, a leverage-generating tool including a handle with a tine at one end thereof for slidable positioning within said terminal part of said slot in said clip and also including a key secured to said tine, said key having a vertical member for slidable positioning within said channel part of said slot.

5. The wire tightening device according to claim 4 wherein said key also has a horizontal member extending outwardly at right angles from the bottom of said vertical member for releasably engaging and supporting said parallel legs of said clip.

6. The wire tightening device according to claim 4 wherein said handle of said leverage-generating tool includes:

a lever portion with a lower end and an upper end;

a crank portion extending at a right angle from said lower end of said lever portion;

a guide portion extending from said upper end of said lever portion in a direction opposite that of said crank portion, said guide portion having a free end remote from said lever portion; and, said tine extending upwardly from said free end of said guide portion.

7. The wire tightening device according to claim 6 wherein said key also has a horizontal member extending outwardly at right angles from the bottom of said vertical member for releasably engaging and supporting said parallel legs of said clip.

8. A wire tightening device, comprising:

a clip including a tensioning arm, with an outer end having an upwardly-extending crook, and a retaining arm joined together at their respective inner ends, and held in axial alignment, by a laterally-extending, winding portion, said winding portion having a pair of parallel legs projecting from said inner ends of said tensioning and retaining arms and an open loop joining said legs in a spaced-apart relationship, said open loop having an outer diameter greater than the distance between said inner ends of said tensioning and retaining arms, and said winding portion having a keyhole slot with a narrow, channel part extending between said legs and a relatively wide, circular, terminal part within said open loop; and, a leverage-generating tool including:

a handle having a lever portion with a lower end and an upper end, a crank portion extending at a right angle from said lower end of said lever portion, a guide portion extending from said upper end of said lever portion in a direction opposite that of said crank portion, said guide portion having a free end remote from said lever portion, and a tine extending upwardly from said free end of said guide portion adapted for insertion into said terminal part of said slot in said clip; and, a key affixed to said tine, said key including a vertical member for slidable positioning within said channel part of said slot and a horizontal member extending outwardly from the bottom of said vertical member for releasably engaging and supporting said parallel legs of said clip.

* * * * *